United States Patent [19]

Stratton

[11] Patent Number: 4,516,772

[45] Date of Patent: May 14, 1985

[54] BASEBALL BATTING TRAINER

[76] Inventor: William P. Stratton, 815 Coronado Ct., San Diego, Calif. 92109

[21] Appl. No.: 466,098

[22] Filed: Feb. 14, 1983

[51] Int. Cl.[3] ..... A63B 69/40

[52] U.S. Cl. ..... 273/26 R; 273/188 A

[58] Field of Search ..... 273/26 R, 25, 183 R, 273/183 B, 188 A, 187 R, 187 A, 187 B, 59 A, 55 R, 186 C

[56] References Cited

U.S. PATENT DOCUMENTS

| | | | |
|---|---|---|---|
| 3,244,421 | 4/1966 | Hanna | 273/187 R |
| 3,815,906 | 6/1974 | Hermo | 273/26 R |
| 3,868,116 | 2/1975 | Ford et al. | 273/187 R |
| 4,146,231 | 3/1979 | Merkle et al. | 273/187 R |

*Primary Examiner*—Richard C. Pinkham
*Assistant Examiner*—T. Brown
*Attorney, Agent, or Firm*—Charmasson & Holz

[57] ABSTRACT

A baseball batting trainer utilizing an elongated guiding rail, one end of which defines a positioner for the rear foot of a batter, there being a moving foot guide which slides along the rail while controlling the straddling movement of the front foot, and which hits a stop positioned on the rail at a certain point to define the furthermost position that the batter's front foot should assume before the swing. A rear stop behind the front foot guide defines the position of the front foot before the straddling movement starts, these stops being adjustable to accommodate the styles of different batters.

10 Claims, 10 Drawing Figures

FIG. 1
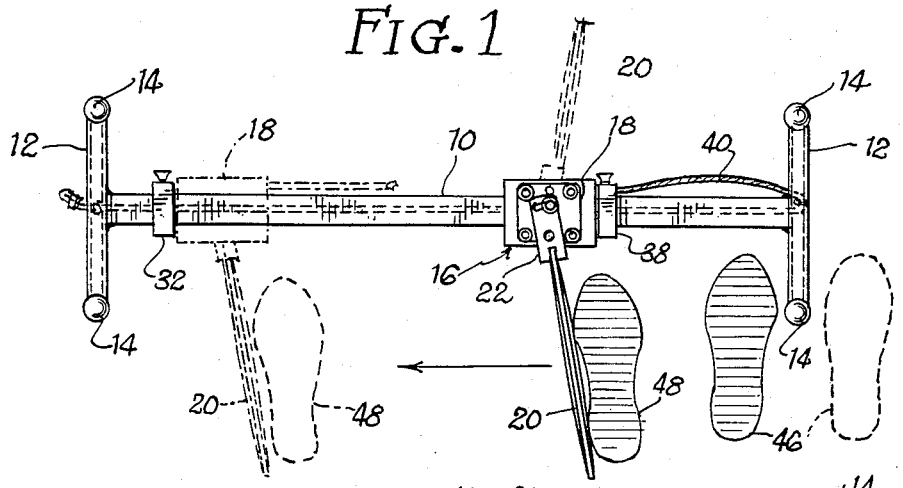
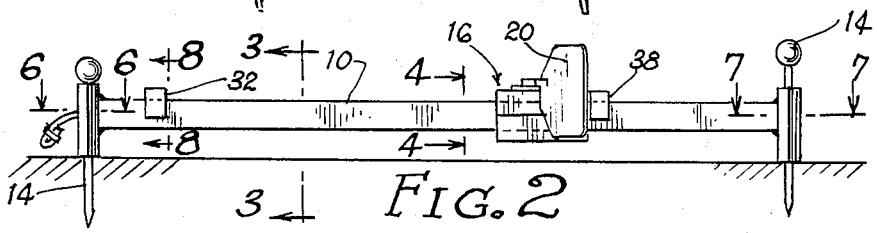
FIG. 2
FIG. 3
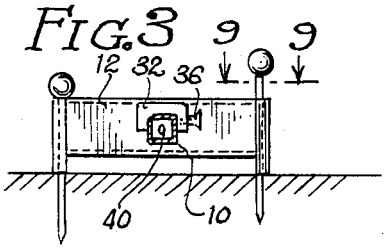
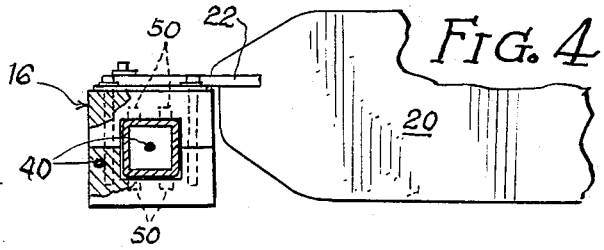
FIG. 4
FIG. 6
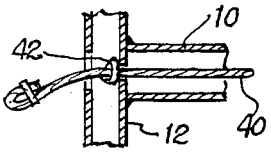
FIG. 5
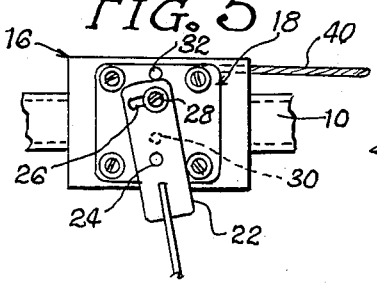
FIG. 7
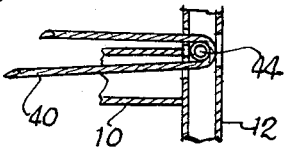
FIG. 8
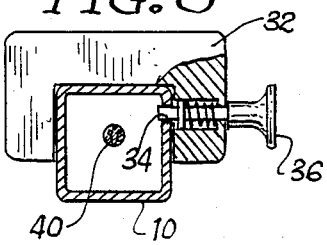
FIG. 9
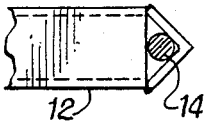
FIG. 10
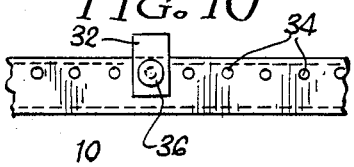

BASEBALL BATTING TRAINER

BACKGROUND OF THE INVENTION

In baseball, as with many other sports, including golf, over-the-line softball, and any other sport wherein a ball is struck by a person who is substantially stationary, it is important that the feet be properly positioned. Golfers for example have numerous devices to properly position the feet, align the hips, orient the head, hold the shoulders, etc., for the optimal golf stroke.

It is in this field of devices that the instant trainer falls. Specifically, baseball players, especially young little leaguers and the like, need guidance in properly positioning their feet when swinging the bat. There is an optimal positioning of the feet at the beginning of the straddling movement preceding the swing, together with the proper positioning at the end of it.

This requires a positioner for the rear foot, which remains more or less stationary, and a straddling positioner for the forward foot, which of necessity moves forward a step as the swinger straddles into the batting position. There is need for some way of gauging the ideal starting position of the foot which will later move, and the finishing position of this foot. This would require some moving structure, indicating where the forward foot should start at the beginning of the straddle, and after following the foot out would indicate where the foot should terminate its movement.

SUMMARY OF THE INVENTION

The instant invention fulfills the above-stated need by providing a training device having a guiding rail, the rear end of which defines a rear foot positioner. The ends of this rail provide means for staking the trainer into the dirt for training. A forward, moving foot guide actually slides along the rail, and is tensioned rearwardly slightly by an elastic cord. This foot guide extends from a rider which slides on the rail between the rear stop and the forward stop, each of which is adjustable to accommodate batters of different sizes and swinging styles.

The front foot guide is reversible so that it can be used for left or right-handed swingers.

BRIEF DESCRIPTION OF THE DRAWINGS

FIG. 1 is a top elevation view of the trainer illustrating the forward foot guide in its forward position in phantom;

FIG. 2 is an elevation view o the trainer seen from the side the player is standing on in FIG. 1;

FIG. 3 is a section taken along line 3—3 of FIG. 2;

FIG. 4 is a section taken along line 4—4 of FIG. 2;

FIG. 5 is a plan form of a detail illustrating the angular adjustability of the front foot guide;

FIG. 6 is a section taken along line 6—6 of FIG. 2;

FIG. 7 is a section taken along line 7—7 of FIG. 2;

FIG. 8 is a section taken along line 8—8 of FIG. 2, with portions cut away;

FIG. 9 is an elevation view cutting through a stake taken in FIG. 3; and FIG. 10 illustrates the row of holes in which the pull pins engage.

DETAILED DESCRIPTION OF THE PREFERRED EMBODIMENT

As seen in FIG. 1, the trainer comprises an elongated guide rail 10 which in the preferred embodiment is rectangular in cross section and made of steel, tough plastic, or other rugged material. At each end of the rail 10 are disposed endpieces 12, each of which defines bores or apertures through which the stakes 14 can be used to secure the trainer in the ground. The endpieces could be made of sheet metal and welded to the rail.

Sliding on this guide rail on roller bearings 50, is a rider 16 on which is mounted a front foot guide 18 which includes a paddle-like element 20 and a mounting bracket 22. As can be seen in FIG. 5, the mounting bracket pivots at 24 and defines an arcuate slot 26 for angular adjustment of the paddle. Bolt 28 anchors the paddle at whatever position is selected. Using bore 30 and pin 31, the paddle can be mounted on the other side of the guiding rail for left-handed batters.

In front of the foot guide 18 is a front stop 32 which is adjustable along the length of the guide rail 10 by virtue of a series of holes 34 into which engage selectably spring-loaded pull pin 36 detailed in FIG. 8. An identical rear stop 38 defines the rearmost position of the front foot guide.

To bias the foot guide rearwardly, an elastic cord 40 is tied to the forward end of the guide rail as indicated at 42, extends through the guide rail, over the large diameter pin 44 and is fastened to the front foot guide 18. As shown in FIG. 1, the right foot 46 could be on the left side of the right endpiece 12, which also doubles as a rear foot guide, or to the right side of it as shown in phantom for a larger player. The left, or front, foot 48 stands on the right side of the paddle, and pushes the paddle out with it, as shown in phantom, as the batter straddles.

The coach or trainer can establish the optimal positions of the stops for the various players, and over a period of time, the player will become accustomed to stopping his foot exactly where the forward, front foot guide stops.

Being multiply adjustable, and equally adapted for left-handed batters as right, and having a front moving foot guide that is angularly adjustable, the unit is versatile and universally adapted for the use of any baseball player.

While the preferred embodiment of the invention has been described, other modifications may be made thereto and other embodiments may be devised within the spirit of the invention and the scope of the appended claims.

What is claimed is:

1. A baseball batter's trainer for training batters in proper foot position and movement during the batting swing comprising:

(a) means for positioning the batter's rear foot;

(b) a rail extending along the desired path of the batter's front foot during a swing; and (c) a front foot guide slideably movable along said rail;

said front foot guide comprising a rider slideably movable on said guide rail; a paddle extended from said rider to engage the forward portion of the foot; and means for biasing said paddle rearwardly.

2. Structure according to claim 1 which further comprises means for adjusting said paddle about a vertical axis.

3. Structure according to claim 2 which further comprises means for reversing said paddle to extend from either side of the guide rail.

4. Structure according to claim 1 wherein said rail is hollow and said means for biasing comprises a resilient cord extending from the front end of said rail rearwardly through same, and then forward outside of said guide rail to connect to said rider.

5. Structure according to claim 1 and including an endpiece at each end of said rail, and said endpieces defining stake-down apertures.

6. Structure according to claim 5 wherein the rear endpiece serves as means for positioning the batter's rear foot.

7. Structure according to claim 5 and including a forward stop mounted on said rail for defining the forwardmost position of said movable foot guide.

8. Structure according to claim 7 and including a rear stop mounted on said rail for establishing a rearmost position for said movable foot guide.

9. Structure according to claim 1 and including at least one stop for said movable foot guide, and means for adjustably securing said one stop at various positions along said rail.

10. Structure according to claim 9 wherein said means for adjustably securing comprise said rail having a row of holes and a spring-loaded detent pin on said stop for selectively engaging said holes.

* * * * *